US007827997B2

(12) United States Patent
Crooks et al.

(10) Patent No.: US 7,827,997 B2
(45) Date of Patent: Nov. 9, 2010

(54) FILTERED CIGARETTE INCORPORATING AN ADSORBENT MATERIAL

(75) Inventors: Evon Llewellyn Crooks, Mocksville, NC (US); Joanne Naomi Taylor, Germanton, NC (US); Paul Fischer Bernasek, Lexington, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 521 days.

(21) Appl. No.: 11/758,165

(22) Filed: Jun. 5, 2007

(65) Prior Publication Data

US 2007/0227548 A1 Oct. 4, 2007

Related U.S. Application Data

(63) Continuation of application No. 10/675,241, filed on Sep. 30, 2003, now Pat. No. 7,240,678.

(51) Int. Cl.
*A24D 3/04* (2006.01)

(52) U.S. Cl. ..... 131/343; 131/334

(58) Field of Classification Search ..... 131/343
See application file for complete search history.

(56) References Cited

U.S. PATENT DOCUMENTS

| | | | |
|---|---|---|---|
| 2,792,006 | A | 5/1957 | Marek |
| 2,801,638 | A | 8/1957 | Schur et al. |
| 2,815,760 | A | 12/1957 | Schreus et al. |
| 2,827,903 | A | 3/1958 | Niederman |
| 2,881,770 | A | 4/1959 | Touey |
| 2,968,305 | A | 1/1961 | Barnett |
| 3,101,723 | A | 8/1963 | Seligman et al. |
| 3,169,535 | A | 2/1965 | Lassiter et al. |
| 3,217,715 | A | 11/1965 | Berger et al. |
| 3,234,948 | A | 2/1966 | Stebbings |
| 3,251,365 | A | 5/1966 | Keith, II et al. |
| 3,279,476 | A | 10/1966 | Noznick et al. |
| 3,320,960 | A | 5/1967 | Molins |
| 3,347,247 | A | 10/1967 | Lloyd |
| 3,349,780 | A | 10/1967 | Sublett et al. |
| 3,351,071 | A | 11/1967 | Belfort |
| 3,353,544 | A | 11/1967 | Fordyce et al. |

(Continued)

FOREIGN PATENT DOCUMENTS

| | | |
|---|---|---|
| EP | 0 579 410 A1 | 1/1994 |

(Continued)

*Primary Examiner*—Carlos Lopez
(74) *Attorney, Agent, or Firm*—Womble Carlyle Sandridge & Rice, PLLC

(57) ABSTRACT

A filter element incorporating an adsorbent material is provided. The filter element may comprise a first section of filter material and a second section of filter material spaced apart to form a compartment therebetween. The compartment may be filled with one or more adsorbents or the compartment may be divided into two regions, wherein one compartment region is filled with an adsorbent and the other compartment region is either filled with an ion-exchange resin or remains empty. The section of filter material adjacent to the tobacco rod may include one or more channels therethrough for passaging smoke directly from the tobacco rod into the adsorbent-filled compartment. The mouth end section of filter material may contain a breakable capsule, wherein the breakable capsule is filled with a flavoring agent capable of altering the taste characteristics of mainstream smoke.

42 Claims, 3 Drawing Sheets

U.S. PATENT DOCUMENTS 3,409,020 A 11/1968 Westbrook, Jr. et al.
3,413,982 A 12/1968 Sublett et al.
3,424,168 A 1/1969 Lloyd
3,438,381 A 4/1969 Hale
3,460,543 A 8/1969 Keith, II et al.
3,858,587 A 1/1975 Cavelli et al.
3,875,949 A 4/1975 Harendza-Harinxma et al.
3,894,545 A 7/1975 Crellin et al.
4,038,992 A 8/1977 Ogasa et al.
4,163,452 A 8/1979 Green et al.
4,201,234 A 5/1980 Neukomm
4,481,958 A 11/1984 Rainer et al.
4,971,078 A 11/1990 Deutsch et al.
5,129,408 A 7/1992 Jakob et al.
5,360,023 A 11/1994 Blakley et al.
5,423,336 A 6/1995 Mentzel et al.
5,549,125 A 8/1996 White
5,622,190 A 4/1997 Arterbery et al.
5,718,250 A 2/1998 Banerjee et al.
5,724,997 A 3/1998 Smith et al.
5,746,230 A 5/1998 Arterbery et al.
5,909,736 A 6/1999 Stavridis et al.
6,257,242 B1 7/2001 Stavridis
6,345,625 B1 2/2002 Chew
6,422,244 B1 7/2002 Clarke et al.
6,481,442 B1 11/2002 Dyakonov et al.
6,537,186 B1 3/2003 Veluz
6,584,979 B2 7/2003 Xue et al.
6,595,218 B1 7/2003 Koller et al.
6,615,843 B2 9/2003 Pera
6,779,529 B2 8/2004 Figlar et al.
2002/0020420 A1 2/2002 Xue et al.
2002/0166563 A1 11/2002 Jupe et al.
2003/0106562 A1 6/2003 Chatterjee
2003/0159703 A1 8/2003 Yang et al.
2003/0183237 A1 10/2003 Xue et al.
2003/0200973 A1 10/2003 Xue et al.
2004/0025890 A1 2/2004 Yen

FOREIGN PATENT DOCUMENTS

WO WO 02/069745 A1 9/2002
WO WO 03/059096 A1 7/2003
WO WO 03/086116 A1 10/2003
WO WO 2004/073427 A1 9/2004

FILTERED CIGARETTE INCORPORATING AN ADSORBENT MATERIAL

CROSS-REFERENCE TO RELATED APPLICATIONS

This application is a continuation of U.S. application Ser. No. 10/675,241, filed Sep. 30, 2003, now U.S. Pat. No. 7,240, 678, which is incorporated by reference in its entirety.

FIELD OF THE INVENTION

The present invention relates to smoking articles, and in particular, to smoking articles having the form of filtered cigarettes.

BACKGROUND OF THE INVENTION

Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "smokable rod" or "tobacco rod." Normally, a cigarette has a cylindrical filter element aligned in an end-to-end relationship with the tobacco rod. Typically, a filter element comprises cellulose acetate tow plasticized using triacetin, and the tow is circumscribed by a paper material known as "plug wrap." Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth in *Tobacco Production, Chemistry and Technology*, Davis et al. (Eds.) (1999). A smoker employs a cigarette by lighting one end thereof and burning the tobacco rod. The smoker then receives mainstream smoke into his/her mouth by drawing on the opposite end (e.g., the filter end) of the cigarette.

Activated carbon particles or other adsorbent materials, such as silica gel, can be incorporated into a cigarette filter. Exemplary cigarettes and filters therefor are described in U.S. Pat. No. 3,353,543 to Sproull et al. and U.S. Pat. No. 4,481, 958 to Ranier et al, and in PCT WO 02/37990 to Bereman. Certain commercially available filters have particles or granules of carbon (e.g., an activated carbon material or an activated charcoal material) dispersed within a fibrous material, such as described in U.S. Pat. No. 6,584,979 to Xue et al. Other commercially available filters have so-called "compartment filter" or "triple filter" designs, such as those filters described in U.S. Pat. No. 4,163,452 to Green et al.; U.S. Pat. No. 5,129,408 to Jakob et al.; and U.S. Pat. No. 6,537,186 to Veluz; as well as U.S. Patent Application Publication No. 2003/0106562. European Patent Application 0 579 410 A1 describes a filter including an annular section of carbon particles surrounding a cellulose acetate filter section. U.S. Pat. No. 5,360,023 to Blakley et al. describes a filter comprising a gathered paper that includes a carbonaceous material. Adsorbent materials incorporated into a cigarette filter can be used as a substrate for functional groups, such as described in U.S. Pat. No. 6,481,442 to Dyakonov et al. and U.S. Pat. No. 6,595,218 to Koller et al. Flavorants can be added to activated carbon as described in U.S. Patent Application Publication No. 2003/0159703. Exemplary commercially available filters are available as SCS IV Dual Solid Charcoal Filter from American Filtrona Corp.; Triple Solid Charcoal Filter from FIL International, Ltd.; Triple Compartment Filter from Baumgartner; and ACT from FIL International, Ltd.

Cigarette filter elements that incorporate carbon have a propensity to remove certain gas phase components from the mainstream smoke that passes through the filter element during draw by the smoker. Interaction of mainstream smoke with adsorbent substances, such as carbon particles, results in a certain degree of removal of certain gas phase compounds from the smoke. Such a change in the character of the smoke can result in changes in the sensory properties of the smoke. For example, mainstream tobacco smoke that is filtered using a conventional cigarette filter element incorporating carbon can often be characterized as having slightly metallic, drying and powdery flavor characteristics.

It would be desirable to provide a cigarette filter element that efficiently removes significant amounts of certain gas phase components of mainstream cigarette smoke. It would also be desirable to provide a cigarette filter that removes gas phase components of mainstream smoke while still yielding smoke with desirable sensory characteristics.

SUMMARY OF THE INVENTION

The present invention relates to filtered smoking articles, such as cigarettes possessing filter elements. A representative filtered smoking article includes at least one adsorbent incorporated into the filter element. The adsorbent is adapted for adsorption of one or more gas phase constituents of mainstream smoke. The adsorbent is incorporated into one or more segments of a multi-segment filter element. The filter elements of the present invention are capable of removing condensable gas phase components from mainstream tobacco smoke to a significant degree. Condensable gas phase components include organic compounds such as carbonyl compounds (e.g., acetone, formaldehyde, acrolein and acetaldehyde). The present invention provides a cigarette comprising a tobacco rod and a filter element connected to the tobacco rod, the filter element having an end proximal to the tobacco rod and an end distal to the tobacco rod.

In one embodiment, the filter element comprises a first longitudinally extending section of filter material positioned at the end of the filter element proximal to the tobacco rod (i.e., tobacco end section) and a second longitudinally extending section of filter material positioned at the end of the filter element distal to the tobacco rod (i.e., mouth end section) and spaced apart from the first section of filter material, the two sections thus forming and defining a compartment therebetween. An adsorbent material, preferably in granular form, such as granulated activated carbon, is contained within at least a portion of the compartment.

A plurality of ventilation holes adapted for introducing air into the filter element are located at a point along the length of the filter element between the end of the filter element proximal to the tobacco rod and the approximate midpoint of the adsorbent-containing portion of the compartment. Preferably, the ventilation holes are overlying the adsorbent-containing portion of the compartment, specifically between the midpoint of the adsorbent-containing portion of the compartment and the end of the adsorbent-containing portion of the compartment proximal to the tobacco end section of filter material.

The first and second sections of filter material may comprise any filter material known for use in filter elements for cigarettes, such as cellulose acetate tow, gathered cellulose acetate web, polypropylene tow, gathered polypropylene web, gathered polyester web, gathered paper, and strands of reconstituted tobacco. Preferably, the first and second sections of filter material are formed from a fibrous filter material, such as plasticized cellulose acetate tow.

In one preferred embodiment, the tobacco end section of filter material of the above-described filter element has greater particulate removal efficiency than the mouth end section of filter material. For example, the tobacco end section of filter material preferably comprises filaments having a lower weight per unit length than the filaments of the mouth end section of filter material. The tobacco end section of filter material can comprise filaments having a weight per unit length of less than about 2.5 denier per filament and the mouth end section of filter material can comprise filaments having a weight per unit length of greater than about 3.0 denier per filament.

In another embodiment, at least one channel extends through the tobacco end section of filter material, the channel being adapted for passage of mainstream smoke between the tobacco rod and the compartment containing the adsorbent material. A single channel may extend through the tobacco end section of filter material or a plurality of channels can be utilized. In one embodiment, a single channel proximal to the central axis of the tobacco end section of filter material is used. In other embodiments, a plurality of channels extend through the filter material, either spaced along the periphery of the filter material or grouped in the area proximal to the central axis of the tobacco end section of filter material. The total cross-sectional area of the one or more channels extending through the first section of filter material may be about 0.1 to about 50 $mm^2$, preferably about 0.5 to about 15 $mm^2$.

In further embodiments of the filter element of the invention, the compartment defined by the first and second longitudinally extending sections of filter material is divided into two sections or regions by a semi-permeable barrier. The semi-permeable barrier may be constructed of any material that allows permeation of mainstream smoke, but retains the adsorbent material in a defined portion of the compartment. Exemplary materials for the semi-permeable barrier include highly porous paper, cellulose acetate tow, gathered cellulose acetate web, polypropylene tow, gathered polypropylene web, and gathered polyester web.

The barrier divides the compartment into at least two regions. In one embodiment, the barrier divides the compartment into a first region containing an adsorbent material, such as activated carbon, and a second region containing an ion-exchange resin. Preferably, both the adsorbent material and the resin are in granular form. The ion-exchange resin is preferably a strong base anion exchange resin or a weak base anion exchange resin. In another embodiment, an adsorbent material is contained within the region furthest from the end of the tobacco rod and the region nearest to the tobacco rod is empty, thus creating a hollow space that can enhance intermixing of mainstream smoke prior to entry of the smoke into the portion of the compartment containing the adsorbent.

In yet another embodiment, the filter element of the invention comprises an adsorbent material and at least one breakable capsule positioned in the mouth end section of filter material. The breakable capsule preferably comprises an outer gelatin shell and an inner liquid composition including one or more flavoring agents and a diluting agent. Positioning the breakable capsule downstream from the adsorbent material allows the smoker to selectively adjust the flavor of the cigarette as a means to complement taste attributes.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

In order to assist the understanding of embodiments of the invention, reference will now be made to the appended drawings, in which like reference numerals refer to like elements and which are not necessarily drawn to scale. The drawings are exemplary only, and should not be construed as limiting the invention.

DETAILED DESCRIPTION OF THE PREFERRED EMBODIMENTS

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. It must be noted that, as used in this specification, the singular forms "a," "an," and "the" include plural referents unless the context clearly dictates otherwise.

Figure 1:
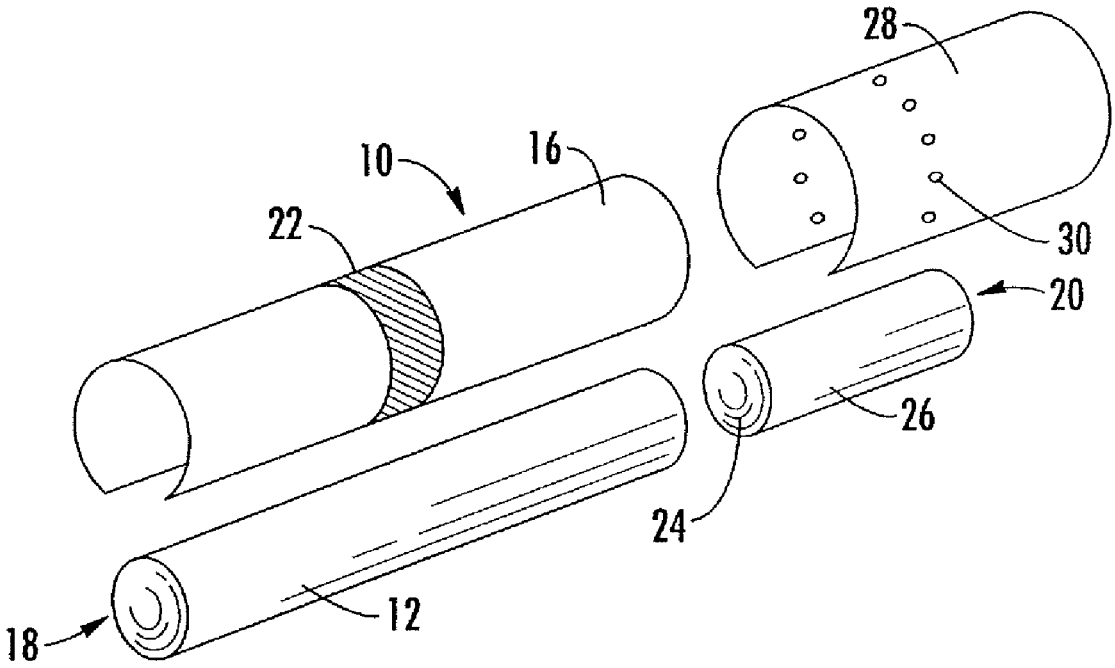
FIG. 1 is an exploded perspective view of a smoking article having the form of a cigarette, showing the smokable material, the wrapping material components, and the filter element of the cigarette.

The present invention is directed to filter elements adapted for use in filtering mainstream smoke generated by smoking articles, such as cigarettes, wherein the filter elements contain at least one adsorbent material. Referring to FIG. 1, a smoking article 10 in the form of a cigarette is shown. The cigarette 10 includes a generally cylindrical rod 12 of a charge or roll of smokable filler material contained in a circumscribing wrapping material 16. The rod 12 is conventionally referred to as a "tobacco rod". The ends of the tobacco rod are open to expose the smokable filler material. One end of the tobacco rod 12 is the lighting end 18 and a filter element 20 is positioned at the other end. The cigarette 10 is shown as having one optional printed band 22 on wrapping material 16, and that band circumscribes the cigarette rod in a direction transverse to the longitudinal axis of the cigarette. That is, the band provides a cross-directional region relative to the longitudinal axis of the cigarette. The band can be printed on the inner surface of the wrapping material (i.e., facing the smokable filler material) or on the outer surface of the wrapping material. Although the cigarette shown in FIG. 1 possesses wrapping material having one optional band, the cigarette also can possess wrapping material having further optional spaced bands numbering two, three, or more.

The cigarette 10 includes a filter element 20 positioned adjacent one end of the tobacco rod 12 such that the filter element and tobacco rod are axially aligned in an end-to-end relationship, preferably abutting one another. Filter element 20 has a generally cylindrical shape, and the diameter thereof is essentially equal to the diameter of the tobacco rod. The ends of the filter element 20 are open to permit the passage of air and smoke therethrough. The filter element 20 includes at least one segment or section of filter material 24 (e.g., plasticized cellulose acetate tow) that is overwrapped along the longitudinally extending surface thereof with circumscribing plug wrap material 26. A typical plug wrap material 26 is a paper material, such as a paper that is porous or non-porous to air flow. The filter element 20 can have two or more segments of filter material, and/or flavor additives incorporated therein.

The filter element 20 is attached to the tobacco rod 12 by tipping material 28, which circumscribes both the entire length of the filter element and an adjacent region of the tobacco rod. The inner surface of the tipping material 28 is fixedly secured to the outer surface of the plug wrap 26 and the outer surface of the wrapping material 16 of the tobacco rod using a suitable adhesive. A ventilated or air diluted smoking article is provided with an air dilution means, such as a series of perforations 30, each of which extend through the tipping material 28 and plug wrap 26. When air diluted, the filter element normally is ventilated to provide a cigarette having an air dilution between about 10 and about 75 percent, preferably about 30 to about 40 percent. As used herein, the term "air dilution" is the ratio (expressed as a percentage) of the volume of air drawn through the air dilution means to the total volume of air and smoke drawn through the cigarette and exiting the extreme mouth end portion of the cigarette. See, Selke, et al., Beitr. Zur Tabak. In., Vol. 4, p. 193 (1978). The perforations 30 can be made by various techniques known to those of ordinary skill in the art. For example, the perforations 30 can be made using mechanical or microlaser offline techniques or using online laser perforation.

Preferred cigarettes of the present invention exhibit desirable resistance to draw. For example, an exemplary cigarette exhibits a pressure drop of between about 50 and about 200 mm water pressure drop at 17.5 cc/sec. air flow. Preferred cigarettes exhibit pressure drop values of between about 60 mm and about 180 mm, more preferably between about 70 mm to about 150 mm, water pressure drop at 17.5 cc/sec. air flow. Typically, pressure drop values of cigarettes are measured using a Filtrona Filter Test Station (CTS Series) available from Filtrona Instruments and Automation Ltd or a Quality Test Module (QTM) available from the Cerulean Division of Molins, PLC.

The dimensions of a representative cigarette 10 can vary. Preferred cigarettes are rod shaped and have circumferences of about 17 mm to about 27 mm. The total length of the cigarette 10 is typically about 80 mm to about 150 mm.

The length of the filter element 20 can vary. Typical filter elements can have lengths of about 15 mm to about 65 mm, frequently about 25 to about 50 mm. The tipping paper 28 will typically circumscribe the entire filter element 20 and about 4 mm of the length of the tobacco rod 12 in the region adjacent to the filter element.

The wrapping materials used to circumferentially wrap the tobacco rod can vary. Preferably, the wrapping material is a paper material, such as the type of paper material typically used in cigarette manufacture. The wrapping material can have a wide range of compositions and properties. The selection of a particular wrapping material will be readily apparent to those skilled in the art of cigarette design and manufacture. Smokable rods can have one layer of wrapping material; or smokable rods can have more than one layer of circumscribing wrapping material, such as is the case for the so-called "double wrap" smokable rods. The wrapping material can be composed of materials, or be suitably treated, in order that the wrapping material does not experience a visible staining as a result of contact with components of the smokable material (e.g., aerosol forming material). Exemplary types of wrapping materials, wrapping material components and treated wrapping materials are described in U.S. Pat. No. 5,105,838 to White et al.; U.S. Pat. No. 5,271,419 to Arzonico et al. and U.S. Pat. No. 5,220,930 to Gentry; PCT WO 01/08514 to Fournier et al.; PCT WO 03/043450 to Hajaligol et al.; US Pat. Application 2003/0114298 to Woodhead et al.; US Pat. Application 2003/0131860 to Ashcraft et al.; and U.S. patent application Ser. No. 10/324,418, filed Dec. 20, 2002; Ser. No. 10/440,290, filed May 16, 2003; and Ser. No. 10/645,996, filed Aug. 12, 2003,which are incorporated herein by reference in their entireties. Representative wrapping materials are commercially available as R. J. Reynolds Tobacco Company Grades 119, 170, 419, 453, 454, 456, 465, 466, 490, 525, 535, 557, 652, 664, 672, 676 and 680 from Schweitzer-Maudit International. The porosity of the wrapping material can vary, and frequently is between about 5 CORESTA units and about 100 CORESTA units, often is between about 10 CORESTA units and about 90 CORESTA units, and frequently is between about 20 CORESTA units and about 80 CORESTA units.

The wrapping material typically incorporates a fibrous material and at least one filler material imbedded or dispersed within the fibrous material. The fibrous material can vary. Most preferably, the fibrous material is a cellulosic material. Preferably, the filler material has the form of essentially water insoluble particles. Additionally, the filler material normally incorporates inorganic components. The filler material may comprise catalysts or adsorbent materials capable of adsorbing or reacting with vapor phase components of mainstream smoke. Filler materials incorporating calcium salts are particularly preferred. One exemplary filler material has the form of calcium carbonate, and the calcium carbonate most preferably is used in particulate form. See, for example, U.S. Pat. No. 4,805,644 to Hampl; U.S. Pat. No. 5,161,551 to Sanders; and U.S. Pat. No. 5,263,500 to Baldwin et al.; and PCT WO 01/48,316. Other filler materials include agglomerated calcium carbonate particles, calcium tartrate particles, magnesium oxide particles, magnesium hydroxide gels; magnesium carbonate-type materials, clays, diatomaceous earth materials, titanium dioxide particles, gamma alumina materials and calcium sulfate particles. The filler can be selected so as to impart certain beneficial characteristics to the wrapping material, such as modification of combustion properties or the ability to adjust the character and content of mainstream smoke (e.g., by adsorption of certain compounds).

The production of filter rods, filter rod segments and filter elements, and the manufacture of cigarettes from those filter rods, filter rod segments and filter elements, can be carried out using the types of equipment known in the art for such uses. Multi-segment cigarette filter rods can be manufactured using a cigarette filter rod making device available under the brand name Mulfi from Hauni-Werke Korber & Co. KG. Six-up rods, four-up filter rods and two-up rods that are conventionally used for the manufacture of filtered cigarettes can be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. No. 3,308,600 to Erdmann et al.; U.S. Pat. No. 4,281,670 to Heitmann et al.; U.S. Pat. No. 4,280,187 to Reuland et al.; and U.S. Pat. No. 6,229,115 to Vos et al.

Tobacco materials useful for carrying out the present invention can vary. Tobacco materials can be derived from various types of tobacco, such as flue-cured tobacco, burley tobacco, Oriental tobacco or Maryland tobacco, dark tobacco, dark-fired tobacco and *Rustica* tobaccos, as well as other rare or specialty tobaccos, or blends thereof. Descriptions of various types of tobaccos, growing practices, harvesting practices and curing practices are set for in *Tobacco Production, Chemistry and Technology*, Davis et al. (Eds.) (1999). Most preferably, the tobaccos are those that have been appropriately cured and aged.

Typically, tobacco materials for cigarette manufacture are used in a so-called "blended" form. For example, certain popular tobacco blends, commonly referred to as "American blends," comprise a mixture of flue-cured tobacco, burley tobacco and Oriental tobacco. Such blends, in many cases, contain tobacco materials that have a processed form, such as processed tobacco stems (e.g., cut-rolled or cut-puffed stems), volume expanded tobacco (e.g., puffed tobacco, such as dry ice expanded tobacco (DIET), preferably in cut filler form). Tobacco materials also can have the form of reconstituted tobaccos (e.g., reconstituted tobaccos manufactured using paper-making type or cast sheet type processes). The precise amount of each type of tobacco within a tobacco blend used for the manufacture of a particular cigarette brand varies from brand to brand. See, for example, *Tobacco Encyclopedia*, Voges (Ed.) p. 44-45 (1984), Browne, *The Design of Cigarettes,* 3rd Ed., p. 43 (1990) and *Tobacco Production, Chemistry and Technology*, Davis et al. (Eds.) p. 346 (1999). Various representative tobacco types, processed types of tobaccos, types of tobacco blends, cigarette components and cigarette configurations are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,159,942 to Brinkley et al.; U.S. Pat. No. 5,220,930 to Gentry; and U.S. Pat. No. 5,360,023 to Blakley et al.; US Pat. Applications 2002/0000235 to Shafer et al.; 2003/0075193 to Li et al.; and 2003/0131859 to Li et al.; PCT WO 02/37990 to Bereman; U.S. patent application Ser. No. 10/285,395, filed Oct. 31, 2002, to Lawson et al.; U.S. patent application Ser. No. 10/463,211, filed Jun. 17, 2003, to Perfetti et al.; and Bombick et al., *Fund. Appl. Toxicol.,* 39, p. 11-17 (1997); which are incorporated herein by reference.

Tobacco materials typically are used in forms, and in manners, that are traditional for the manufacture of smoking articles, such as cigarettes. The tobacco normally is used in cut filler form (e.g., shreds or strands of tobacco filler cut into widths of about 1/10 inch to about 1/60 inch, preferably about 1/20 inch to about 1/35 inch, and in lengths of about 1/4 inch to about 3 inches). The amount of tobacco filler normally used within the tobacco rod of a cigarette ranges from about 0.5 g to about 1 g. The tobacco filler normally is employed so as to fill the tobacco rod at a packing density of about 100 mg/cm$^3$ to about 300 mg/cm$^3$, and often about 150 mg/cm$^3$ to about 275 mg/cm$^3$.

If desired, the tobacco materials of the tobacco rod can further include other components. Other components include casing materials (e.g., sugars, glycerin, cocoa and licorice) and top dressing materials (e.g., flavoring materials, such as menthol). The selection of particular casing and top dressing components is dependent upon factors such as the sensory characteristics that are desired, and the selection of those components will be readily apparent to those skilled in the art of cigarette design and manufacture. See, Gutcho, *Tobacco Flavoring Substances and Methods*, Noyes Data Corp. (1972) and Leffingwell et al., *Tobacco Flavoring for Smoking Products* (1972).

One exemplary tobacco blend for use in the present invention comprises about 25 to about 98 weight percent flue-cured tobacco, about 10 to about 30 weight percent burley tobacco, about 10 to about 30 weight percent Oriental tobacco, about 10 to about 30 weight percent reconstituted flue-cured and/or Oriental tobacco leaf, about 10 to about 50 weight percent expanded flue-cured tobacco lamina, optionally about 5 to about 20 weight percent expanded flue-cured tobacco stems, and about 2 to about 8 weight percent of a casing material. Optionally, the blend may further include about 0.25 to about 2 weight percent of flavors in the form of a top dressing, preferably about 0.5 to about 1.5 weight percent. A preferred top dressing composition comprises of flavors with vapor pressures not exceeding about 2.0 mm Hg. at 40° C.

In a preferred embodiment, the tobacco blend comprises about 25 to about 70 weight percent flue-cured tobacco, about 12 to about 20 weight percent burley tobacco, about 15 to about 20 weight percent Oriental tobacco, about 15 to about 20 weight percent reconstituted flue-cured and/or Oriental tobacco leaf, about 20 to about 30 weight percent expanded flue-cured tobacco lamina, optionally about 10 to about 15 weight percent expanded flue-cured tobacco stems, and a casing material in an amount of about 3 to about 5 weight percent.

The casing material preferably includes various flavoring ingredients known in the art, such as cocoa, licorice, various sugars, and glycerin. In one embodiment, the casing material includes components derived or extracted from a fig plant (e.g., Fig Supreme Flavor available from Bell Flavors, Inc.). One exemplary casing composition is disclosed in U.S. Pat. No. 5,360,023 to Blakley et al., which is incorporated by reference herein.

The level of "tar" and nicotine delivered by the cigarettes of the invention will vary. Typically, the cigarettes of the invention will deliver the "tar" and nicotine amounts described in U.S. Pat. No. 4,836,224, which is incorporated by referenced herein. Cigarettes of this invention generally deliver from about 0.2 mg to about 3.5 mg, frequently from about 0.3 mg to about 2.5 mg, more frequently from about 0.6 mg to about 1.2 mg of nicotine when smoked under FTC smoking conditions. Cigarettes of this invention generally deliver from about 0.5 to about 18 mg, frequently from about 3 to about 13 mg, more frequently about 5 to about 11 mg "tar" when smoked under FTC smoking conditions.

In one embodiment, the tobacco blend includes a mixture of C3-C20 organic acids, typically C3-C12 organic acids, such as levulinic acid, pyruvic acid, and lactic acid. The mixture preferably includes levulinic acid and one or more additional C3-C6 organic acids. An exemplary organic acid mixture comprises levulinic, pyruvic acid and lactic acid in a 1:1:1 ratio by weight. The amount of organic acid added to the cigarette preferably provides a ratio of organic acid to nicotine on a mole basis of about 1:1 to about 3:1; more preferably about 1.5:1 to about 2.5:1. In one preferred embodiment, the ratio of moles of organic acid to moles of nicotine is about 2:1. The organic acids can be added as part of a casing or top dressing composition, or can be added to one or more of the tobacco components of the tobacco blend prior to blending. For example, the organic acids can be added to the aqueous extract formed during manufacture of a reconstituted tobacco sheet.

The tobacco blend may contain an aerosol forming material. The aerosol forming material can vary, and mixtures of various aerosol forming materials can be used. Representative types of aerosol forming materials are set forth in U.S. Pat. No. 4,793,365 to Sensabaugh, Jr. et al.; and U.S. Pat. No. 5,101,839 to Jakob et al.; PCT WO 98/57556 to Biggs et al.; and *Chemical and Biological Studies on New Cigarette Prototypes that Heat Instead of Burn Tobacco*, R. J. Reynolds Tobacco Company Monograph (1988); which are incorporated herein by reference. A preferred aerosol forming material produces a visible aerosol upon the application of sufficient heat thereto, and a highly preferred aerosol forming material produces an aerosol that can be considered to be "smoke-like." A preferred aerosol forming material is chemically simple, relative to the chemical nature of the smoke produced by burning tobacco. A highly preferred aerosol forming material is a polyol, such as glycerin.

The amount of aerosol forming material employed relative to the dry weight of smokable material present in a smokable rod can vary. For a smokable rod, the amount of aerosol forming material present in that rod is more than about 2 percent, and generally is more than about 3 percent, of the combined dry weight of the aerosol forming material and tobacco material within that rod. For a preferred smokable rod, the amount of aerosol forming material present in that rod typically is at least about 5 percent, generally is at least about 10 percent, often is at least about 15 percent, frequently is at least about 20 percent, and even can be at least about 25 percent, of the combined dry weight of the aerosol forming material and tobacco material within that rod. For a preferred smokable rod, the amount of aerosol forming material present in that rod typically does not exceed about 65 percent, generally does not exceed about 60 percent, often does not exceed about 55 percent, and frequently does not exceed about 50 percent, of the combined dry weight of the aerosol forming material and tobacco material in that rod. Smokable materials possessing exceedingly high levels of aerosol forming material typically are difficult to process into cigarette rods using conventional types of automated cigarette manufacturing equipment.

Cast sheet types of smokable materials typically can incorporate relatively high levels aerosol forming material. Reconstituted tobaccos manufactured using paper-making types of processes typically can incorporate moderate levels of aerosol forming material. Tobacco strip and tobacco cut fuller can incorporate lower amounts of aerosol forming material. For processed materials, such as cast sheet materials and paper-type reconstituted tobaccos, tobacco pulp materials that are extracted with aqueous liquids can be used as components thereof. The removal of essentially all or some fraction of the water soluble components of tobacco can assist in providing a processed material that is capable of acting as an effective substrate for higher levels of aerosol forming material. In addition, dusting processed materials with dry tobacco powders can assist in providing processed materials having relatively high levels of glycerin while not demonstrating overly tacky or sticky characteristics. Cast sheet materials, and particularly cast sheet materials incorporating certain amounts of tobacco pulp materials that have extracted with water, often can comprise up to about 65 percent, often up to about 60 percent, and frequently up to about 55 percent, aerosol forming material, based on the dry weight of the tobacco and aerosol forming material in the material so produced. Paper-type reconstituted tobacco materials, and particularly those materials incorporating certain amounts of tobacco pulp materials that have extracted with water, and not reapplying some or all of the water soluble extract components back to that pulp, often can comprise up to about 55 percent, often up to about 50 percent, and frequently up to about 45 percent, aerosol forming material, based on the dry weight of the tobacco and aerosol forming material in the material so produced. A material produced by spraying tobacco strip or cut filler with aerosol forming material often does not comprise more than about 20 percent, and frequently does not comprise more than about 15 percent, aerosol forming material, based on the dry weight of the tobacco and aerosol forming material of the material so produced.

Other types of materials incorporating relatively high levels of aerosol forming material can be incorporated into a smokable material blend. Formed, encapsulated or microencapsulated materials can be employed. Such types of materials are composed primarily of aerosol forming material, and those materials can incorporate some amount and form of tobacco. An example of such a type of material is a film produced by casting and drying an aqueous solution of about 70 weight parts glycerin and about 30 weight parts binder (e.g., citrus pectin, ammonium alginate, sodium alginate or guar gum), and then surface coating that film with about 2 weight parts of a finely divided powder that is provided by milling tobacco lamina.

FIGS. 2-10 illustrate various embodiments of the filter element of the invention, which is adapted for use with smoking articles such as cigarettes. The filter element of the invention typically comprises multiple longitudinally extending segments. Each segment can have varying properties and may include various materials capable of filtration or adsorption of particulate matter and/or vapor phase compounds. Typically, the filter element of the invention includes 2 to 6 segments, frequently 2 to 4 segments. In one preferred embodiment, the filter element includes a mouth end segment, a tobacco end segment and a compartment therebetween. This filter arrangement is sometimes referred to as a "compartment filter" or a "plug/space/plug" filter. The compartment may be divided into two or more compartments as described in greater detail below.

In each embodiment shown, at least one substance 34 capable of removing at least one gas phase component of mainstream smoke is incorporated into the filter element. Preferably, the substance is an adsorbent material capable of adsorbing one or more gas phase compounds from the mainstream smoke generated by a smoking article. Exemplary adsorbents 34 include activated carbon, molecular sieves (e.g., zeolites and carbon molecular sieves), clays, activated aluminas, silica gels, and mixtures thereof. The amount of adsorbent 34 within the filter element typically ranges from about 50 to about 250 mg, often about 80 to about 150 mg, and frequently about 90 to about 120 mg.

The form of the adsorbent 34 may vary. Typically, the adsorbent 34 is used in granular or particulate solid form having a particle size of between about 8×16 mesh to about 30×70 mesh using the U.S. sieve system. However, smaller or larger particles could be used without departing from the invention. The terms "granular" and "particulate" are intended to encompass both non-spherical shaped particles and spherical particles, such as so-called "beaded carbon" described in WO 03/059096 A1, which is incorporated by reference herein.

The manner in which the adsorbent 34 is incorporated into the filter element may vary. As shown in the appended drawings, granulated adsorbent can be placed in a compartment within the filter element. However, the adsorbent 34 could also be imbedded or dispersed within a section of filter material, such as a fibrous filter material (e.g., cellulose acetate tow), or incorporated into a paper, such as the carbon-containing gathered paper described in U.S. Pat. No. 5,360,023 to Blakley et al. In addition, an adsorbent material 34 can be placed both in a compartment and imbedded in one or more of the sections of filter material, and the adsorbent material in the compartment and the adsorbent imbedded or dispersed in the filter material can be the same or different.

In one preferred embodiment, the adsorbent is activated carbon. The level of activity of the carbon may vary. Typically, the carbon has an activity of about 60 to about 150 Carbon Tetrachloride Activity (i.e., weight percent pickup of carbon tetrachloride). Activated carbon most useful herein consists primarily of carbon, and preferably has a carbon content above about 80 weight percent, and more preferably above about 90 weight percent. Preferred carbonaceous materials are provided by carbonizing or pyrolyzing bituminous coal, tobacco material, softwood pulp, hardwood pulp, coconut shells, almond shells, grape seeds, walnut shells, macadamia shells, kapok fibers, cotton fibers, cotton linters, and the like. Carbon from almond shells, grape seeds, walnut shells, and macadamia nut shells are particularly preferred and are believed to provide greater vapor phase removal of certain compounds as compared to coconut shell carbon. Examples of suitable carbonaceous materials are activated coconut hull based carbons available from Calgon Corp. as PCB and GRC-11, coal-based carbons available from Calgon Corp. as S-Sorb, BPL, CRC-11F, FCA and SGL, wood-based carbons available from Westvaco as Wv-B, SA-20 and BSA-20, carbonaceous materials available from Calgon Corp. as HMC, ASC/GR-1 and SC II, and Witco Carbon No. 637. Other carbonaceous materials are described in U.S. Pat. No. 4,771,795 to White, et al. and U.S. Pat. No. 5,027,837 to Clearman, et al.; and European Patent Application Nos. 236,922; 419,733 and 419,981. Certain carbonaceous materials can be impregnated with substances, such as transition metals (e.g., silver, gold, copper, platinum, and palladium), potassium bicarbonate, tobacco extracts, polyethyleneimine, manganese dioxide, eugenol, and 4-ketononanoic acid. The carbon composition may also include one or more fillers, such as semolina. Grape seed extracts may also be incorporated into the filter element 20 as a free radical scavenger.

Figure 2:
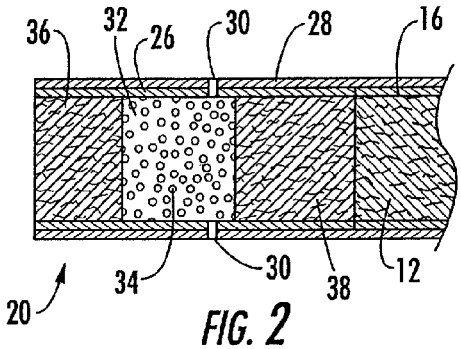
FIG. 2 is a cross-sectional side view of a cigarette of the invention wherein the filter element comprises an adsorbent material positioned within a compartment therein.

FIG. 2 illustrates one embodiment of the filter element 20 of the invention comprising a first section of filter material 36, such as a fibrous filter material (e.g., plasticize cellulose acetate tow) and a second section of filter material 38 spaced apart from the first section of filter material. As shown, the first section of filter material 36 is positioned at the mouth end of the filter element 20 and the second section of filter material 38 is positioned proximal to the tobacco rod 12. The space between the first section of filter material 36 and the second section of filter material 38 define a compartment 32. At least a portion of the compartment 32 contains an adsorbent material 34, preferably in granular form. Typically, substantially the entire compartment 32 contains adsorbent 34.

As shown, the filter element 20 includes ventilation holes 30 that extend through the tipping paper 28 and the plug wrap 26 and, thus, provide air dilution of mainstream smoke. In this embodiment, the ventilation holes 30 are positioned between the approximate midpoint of the adsorbent-containing portion of the compartment 32 and the end of the filter element 20 proximal to the tobacco rod 12. Preferably, ventilation holes 30 are in a position overlying the compartment 32 and preferably positioned between the midpoint of compartment 32 and the end of the compartment adjacent to the second section of filter material 38 upstream from the compartment. Positioning the ventilation holes 30 upstream of at least a portion of the adsorbent-containing compartment 32 can enhance adsorption of certain vapor phase components of mainstream smoke by the adsorbent 34.

The ventilation holes 30 may be configured as a single line of perforations extending circumferentially around the filter element 20 or may comprise several lines of perforations. As would be understood, the exact count and size of the ventilation holes 30 will vary depending on the desired level of air dilution.

The exact distance of the ventilation holes 30 from the end of the filter element 20 proximal to the tobacco rod 12 will vary depending on the length of the individual segments of the filter, such as the segment 38 proximal to the tobacco rod. In certain embodiments, the ventilation holes 30 are about 10 to about 22 mm from the tobacco rod 12, and typically, when the ventilation holes are overlying the adsorbent-containing compartment 32, the holes are within about 5 mm of the section of filter material 38 proximal to the tobacco rod, preferably within about 2 mm.

Figure 3:
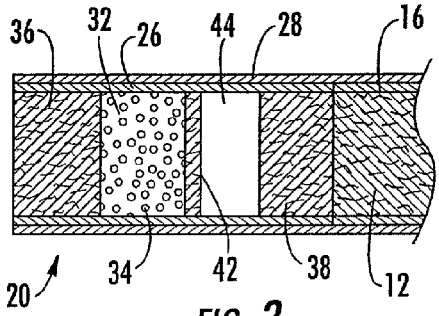
FIG. 3 is a cross-sectional side view of a cigarette of the invention wherein the filter element comprises a compartment divided by a semi-permeable barrier into a hollow portion and a portion containing an adsorbent material.

In another embodiment of the filter element of the invention shown in FIG. 3, the filter element 20 includes a semi-permeable barrier 42 dividing the compartment 32 into two sections or regions. Similar to the embodiment shown in FIG. 2, at least a portion of the compartment 32 is filled with an adsorbent 34. The section of the compartment 32 containing the adsorbent is the downstream section of the compartment. The portion of the compartment 32 upstream of the barrier 42 is hollow. The hollow section 44 of the compartment 32 can provide a mixing region for the mainstream smoke prior to entry of the smoke into the adsorbent material, which can contribute to vapor phase removal by the adsorbent 34.

Figure 4:
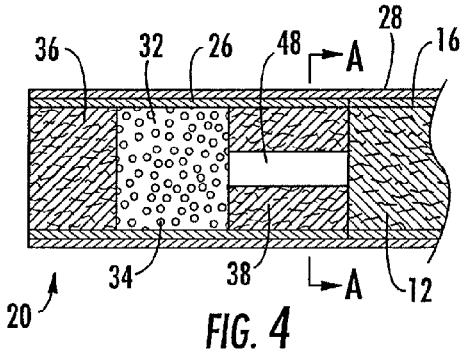
FIG. 4 is a cross-sectional side view of a cigarette of the invention wherein the filter element includes an adsorbent-containing section and at least one channel adapted for passage of mainstream smoke directly from the tobacco rod to the adsorbent-containing portion of the filter.

FIG. 4 illustrates yet another embodiment of the filter element 20 of the invention. As shown, similar to the embodiment shown in FIG. 2 and FIG. 3, a compartment 32 positioned between a mouth end section of filter material 36 and a tobacco end section of filter material 38 is filled with an adsorbent material 34. The section of filter material 38 proximal to the tobacco rod 12 comprises one or more channels extending therethrough, the channel providing a passageway for mainstream smoke passing through the section of filter material 38. The one or more channels 48 provide an unimpeded pathway for mainstream smoke to exit the tobacco rod 12 and enter the compartment 32 containing the adsorbent 34.

Figure 5:
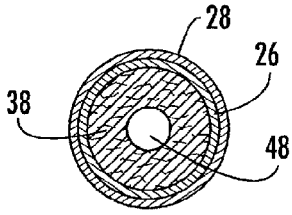
FIG. 5 is a cross-sectional view of the section of the filter element of FIG. 4 taken along line A-A.
Figure 6:
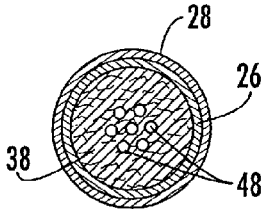
FIG. 6 is a cross-sectional view of a section of the filter element of the invention illustrating an alternative channel configuration.
Figure 7:
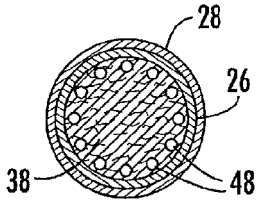
FIG. 7 is a cross-sectional view of a section of the filter element of the invention illustrating another alternative channel configuration.

FIGS. 5-7 illustrate various exemplary configurations for the one or more channels 48 extending through the filter section 38. FIG. 5 is a cross-sectional view taken along line A-A in FIG. 4. As shown in FIG. 5, the filter element may include a single channel 48 extending along, for example, the central axis of the section of filter material 38. Alternatively, as shown in FIGS. 6 and 7, a plurality of smaller channels 48 may be utilized, although the exact placement and configuration of the multiple channels may vary. However, as shown in FIG. 6, one preferred configuration involves placement of a plurality of channels 48 proximal to the central axis of the filter section 38. In an alternative embodiment shown in FIG.

7, the plurality of channels 48 are positioned along the periphery of the filter section 38. In one embodiment, the number of channels 48 is 1 to about 20, preferably 1 to about 15, more preferably 1 to about 10 (e.g., 1, 2, 3, 4, 5, 6, 7, 8, 9, or 10 channels)

The walls of the channel or channels 48 may be defined by the material of the section of filter material 38 or the channels can be formed using tubes (not shown) inserted into the filter material. If tubes are used, the tubes may comprise cellulose acetate, polyethylene, or any other polymeric material capable of forming a self-supporting structure.

The total cross-sectional area of the one or more channels 48 can vary. Typically, the total cross-sectional area of the channel or channels 48 is about 0.1 to about 50 $mm^2$, frequently about 0.5 to about 15 $mm^2$. The cross-sectional shape of the channels 48 is not critical to the invention and may be, for example, rectangular or circular. The diameter of each channel or tube can vary. Typically, the diameter of each channel or tube is about 0.5 to about 8 mm, frequently about 1 to about 3 mm. The diameter of the channel or tube is selected so as to prevent migration of the adsorbent into the channel or tube (i.e., the diameter of the channel or tube is smaller than the diameter of the adsorbent particles).

Figure 8:
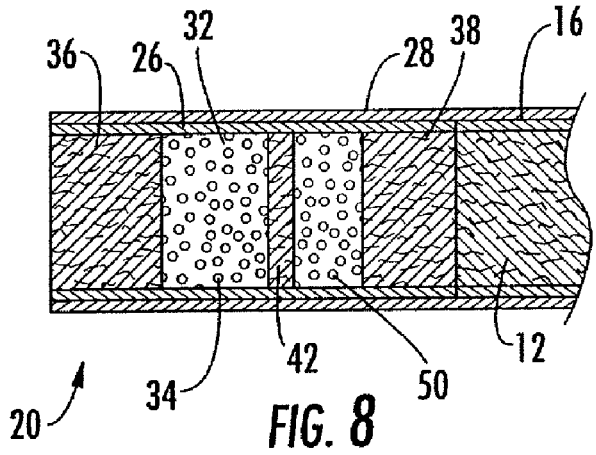
FIG. 8 is a cross-sectional side view of a cigarette of the invention wherein the filter element includes a compartment divided by a semi-permeable barrier, wherein one compartment of the divided compartment contains an adsorbent and the second compartment contains an ion-exchange resin.

FIG. 8 illustrates an embodiment of the filter element 20 of the invention similar to the embodiment illustrated in FIG. 3. As in FIG. 3, the filter element shown in FIG. 8 includes a compartment 32 divided into two sections by a semi-permeable barrier 42. The compartment of the divided compartment 32 downstream from the semi-permeable barrier 42 contains an adsorbent 34. The upstream compartment of the compartment 32 contains an ion-exchange resin 50. Alternatively, although not shown, the present invention further includes embodiments wherein the ion-exchange resin 50 is placed in the downstream compartment of the compartment 32 and the adsorbent 34 is placed in the upstream compartment of the compartment. That is to say, the relative placement of the adsorbent material 34 and the ion-exchange resin 50 may vary in the present invention. In yet another embodiment, the adsorbent 34, such as activated carbon, and the ion-exchange resin 50 can be mixed together and placed in the compartment 32 without physically separating the two materials.

Figure 9:
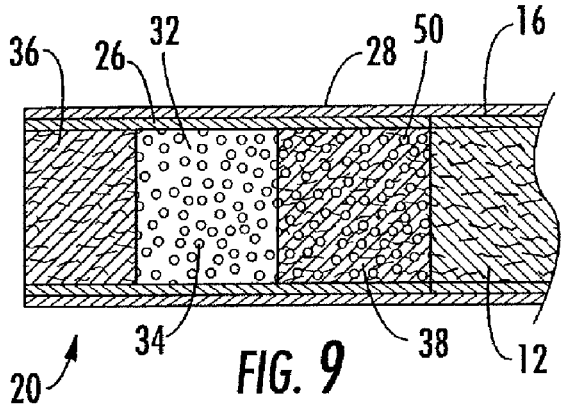
FIG. 9 is a cross-sectional side view of a cigarette of the invention wherein the filter element includes an ion-exchange resin dispersed within a section of filter material.

In an alternative embodiment similar to the embodiment shown in FIG. 8, FIG. 9 illustrates an embodiment wherein the ion-exchange resin 50 is dispersed or imbedded within a section of filter material 38 rather than in a portion of the compartment 32. As noted above, the relative placement of the ion-exchange resin 50 and the adsorbent 34 may vary. As a result, the particles of the ion-exchange resin 50 could alternatively be dispersed within the mouth end section of filter material 36 or both sections of filter material.

The ion-exchange resin 50 can comprise any polymer having active groups in the form of electrically charged sites capable of displacement upon interaction with ions of opposite charge. Typically, the ion-exchange resin 50 comprises a polymer backbone, such as styrene-divinylbenzene (DVB) copolymers, acrylates, methacrylates, phenol formaldehyde condensates, and epichlorohydrin amine condensates, and a plurality of electrically charged functional groups attached to the polymer backbone. The ion-exchange resin 50 is preferably a weak base anion exchange resin or a strong base anion exchange resin. Exemplary resins include DIAION® ion-exchange resins available from Mitsubishi Chemical Corp. (e.g., WA30 and DCA11) and DUOLITE® ion-exchange resins available from Rohm and Haas (e.g., DUOLITE® A7).

The form of the ion-exchange resin 50 can vary. Generally, the ion-exchange resin 50 will be in solid particulate form having a particle size of between about 8×16 mesh to about 30×70 mesh using the U.S. sieve system.

Figure 10:
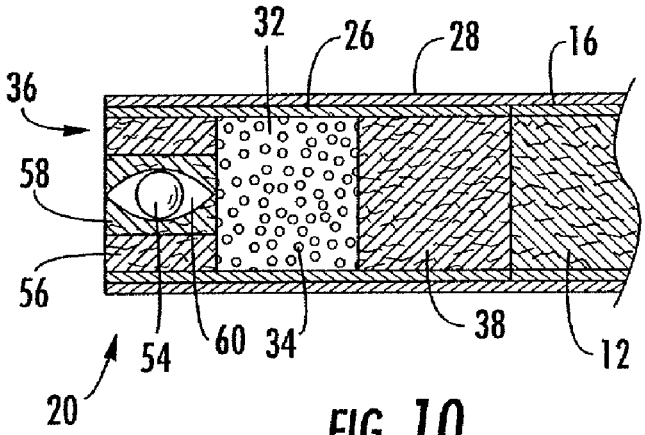
FIG. 10 is a cross-sectional side view of a cigarette of the invention wherein the filter element comprises an adsorbent-filled compartment and a breakable capsule contained within the mouth end section of filter material.

A further embodiment of the filter element 20 of the invention is illustrated in FIG. 10. As shown, this embodiment also includes a compartment 32 between two sections of filter material, 36 and 38. The compartment 32 contains an adsorbent 34. The mouth end section of filter material 36 comprises at least one breakable capsule 54 contained therein. The capsule 54 can be simply imbedded in the filter material 36. In the embodiment shown in FIG. 10, the section of filter material 36 comprises an annular outer section 56 and an inner portion 58 that includes a compartment 60 therein adapted for receiving the breakable capsule 54. As shown, one or both ends of the inner portion 58 of the filter material 36 may be crimped to retain the breakable capsule 54 within the filter element 20. Each breakable capsule 54 carries a payload incorporating a compound that is intended to introduce some change to the nature or character of mainstream smoke drawn through that filter element (e.g., a flavoring agent). The smoker may selectively rupture the capsule 54 in order to release the flavoring agent. It is believed that the use of a breakable capsule 54 containing a flavoring agent downstream of the adsorbent material 34 will provide the smoker with the ability to compliment taste attributes of the smoking article. Since the flavoring agent contained in the capsule 54 is downstream of the adsorbent 34, there is minimal interaction with the adsorbent material. The filter element shown in FIG. 10 having a breakable capsule 54 therein can be manufactured as described in copending U.S. patent application Ser. No. 10/600,712, filed Jun. 23, 2003, which is incorporated by reference herein.

The tipping material 28 connecting the filter element 20 to the tobacco rod 12 can have indicia (not shown) printed thereon. For example, a band (not shown) can indicate to a smoker the general location or position of the capsule 54 within the filter element 20. These indicia may help the smoker to locate the capsule 54 so that it can be more easily ruptured by squeezing the filter element 20 directly outside the position of the capsule. The indicia on the tipping material 28 may also indicate the nature of the payload carried by the capsule 54. For example, the indicia may indicate that the particular payload is a spearmint flavoring by having a particular color, shape, or design.

If desired, the smoker may rupture the capsule 54 at any time before, during, or even after, the smoking experience. Breakage of the capsule 54 acts to release the contents that are contained and sealed therein. Release of the contents of the capsule 54 into the filter element 20 thus enables the smoker to achieve the intended benefit of action of certain of those contents, whether that benefit results from flavoring or scenting the smoke, cooling or moistening the smoke, freshening the scent of the cigarette butt, or achieving some other goal associated with modifying the overall composition of the smoke or altering the performance characteristics of the cigarette. That is, in highly preferred embodiments, a portion of the payload (e.g., portions of a flavoring agent) that has been released into the filter element 20 is incorporated into each subsequent puff of mainstream smoke that is received through that filter element.

Application of tactile pressure to the capsule 54, for example by a squeezing action provided by the fingers of the smoker to the filter element 20, causes relevant regions of the filter element to deform and hence causes the capsule to rupture and release its payload to the compartment interior 60 of the filter element. The rupture of the capsule 54 can be discerned by an audible pop, snap, or a rapid decrease in the resistance to the pressure applied by the smoker. Rupture of the capsule 54 causes contents of its payload to disperse throughout the compartment 60 and throughout the filter tow material in the outer annular filter section 56. Most preferably, the overall cylindrical shape of the filter element 20 returns to essentially its original shape after the application of pressure to the filter element is ceased.

The compartment 60 that houses the capsule 54 preferably possesses a generally circular and/or conical cross-sectional shape and has a diameter of about 3 mm to about 4 mm at its widest point. However, the walls of the compartment 60 may be defined by compressible and deformable material (e.g., plasticized cellulose acetate), and the compartment may be manufactured so as to have a greater or smaller diameter. Accordingly, the compartment 60 may accept one or more capsules 54 having diameters of at least about 1 mm, typically at least about 2 mm, and often at least about 3 mm. Typically, the capsules 54 have diameters that do not exceed about 6 mm, often do not exceed about 5 mm, and frequently do not exceed about 4.5 mm. Certain preferred capsules 54 have diameters in the range of about 3 mm to about 4 mm in diameter, and certain highly preferred capsules are approximately 3.5 mm in diameter.

The capsule 54 is generally spherical in shape and possesses a rigid outer shell, such as a gelatin outer shell, that surrounds an internal payload. Suitable capsules are commercially available from Mane Aromatic Flavors, located in Nice, France as gelatin encapsulated mixtures of medium chain triglycerides and flavor agents. The designations of a number of flavor capsules that are available from Mane Aromatic Flavors are: Spearmint, E209123; Cinnamon, E0303392; Russian Tea, E0303386; Lemon, E127382; and Menthol, E127384. Such representative capsules 54 have diameters of about 3.5 mm and about 4 mm.

The outer shell of the capsule 54 is preferably constructed of a food grade gelatin derived from bovine, picine or porcine stock. A wide variety of gelatins may be used, and the selection of a gelatin for the capsule outer surface is considered a matter of design choice to those of ordinary skill in the art. See, Kirk-Othmer, *Encyclopedia of Chemical Technology*, ($4^{th}$ Ed.) 12, 406-416 (1994), which is incorporated herein by reference. The type of gelatin used for constructing the outer shell of the capsule provides that capsule with the capability of being exposed to triacetin (a common plasticizer used in cigarette filter manufacture) or 1,2 propylene glycol (a common tobacco casing component) for relatively long periods of time without experiencing undesirable interaction (e.g., dissolution of the gelatin therein). Because the gelatins used in the preferred embodiments may dissolve in water over extended periods of time, it is desirable to employ virtually anhydrous payloads (or payloads possessing very low amounts of water) with capsules having gelatin outer coatings.

The capsule payload can have a form that can vary; and typically, the payload has the form of a liquid, a gel, or a solid (e.g., a crystalline material or a dry powder). The payload can incorporate components that aid in flavoring or scenting mainstream cigarette smoke. Alternatively, the payload may be a breath freshening agent for the smoker, a deodorizing agent for the cigarette butt, a moistening or cooling agent for the cigarette smoke, or a composition capable of otherwise altering the nature or character of the cigarette.

In the preferred embodiment, the payload is a mixture of a flavoring and a diluting agent or carrier. The preferred diluting agent is a triglyceride, such as a medium chain triglyceride, and more particularly a food grade mixture of medium chain triglycerides. See, for example, Radzuan et al., *Porim Bulletin,* 39, 33-38 (1999). Flavorings of the payload may be natural or synthetic, and the character of these flavors can be described, without limitation, as fresh, sweet, herbal, confectionary, floral, fruity or spice. Specific types of flavors include, but are not limited to, vanilla, coffee, chocolate, cream, mint, spearmint, menthol, peppermint, wintergreen, lavender, cardamon, nutmeg, cinnamon, clove, cascarilla, sandalwood, honey, jasmine, ginger, anise, sage, licorice, lemon, orange, apple, peach, lime, cherry, and strawberry. See also, Leffingwill et al., *Tobacco Flavoring for Smoking Products*, R. J. Reynolds Tobacco Company (1972). Flavorings also can include components that are considered moistening, cooling or smoothening agents, such as eucalyptus. These flavors may be provided neat (i.e., alone) or in a composite (e.g., spearmint and menthol, or orange and cinnamon). Composite flavors may be combined in a single capsule as a mixture, or as components of multiple capsules positioned within the filter element.

The amount of flavoring and diluting agent within the capsule 54 may vary. In some instances, the diluting agent may be eliminated altogether, and the entire payload can be composed of flavoring agent. Alternatively, the payload can be almost entirely comprised of diluting agent, and only contain a very small amount of relatively potent flavoring agent. In the preferred embodiment using a capsule of approximately 3.5 mm in diameter, the weight of the liquid payload (e.g., flavoring agent and diluting agent) is preferably in the range of about 15 mg to about 25 mg, and more preferably in the range of about 20 mg to about 22 mg. The preferred composition of the mixture of flavoring and diluting agent is in the range of about 5 percent to about 25 percent flavoring, and more preferably in the range of about 10 to about 15 percent flavoring, by weight based on the total weight of the payload, with the balance being diluting agent.

The above filter element 20 embodiments are not mutually exclusive, meaning that aspects of more than one filter embodiment may be combined to further enhance the properties of the filter. For example, a filter combining an adsorbent and ion-exchange resin, as shown in FIGS. 8-9 can also include the flow channels shown in FIG. 4 and/or a hollow compartment as shown in FIG. 3 and/or a breakable capsule as shown in FIG. 10.

In each embodiment described above, the first section of filter material 36 and the second section of filter material 38 may comprise any filter material capable of filtering particulate matter entrained in mainstream smoke generated by a smoking article. Exemplary filter materials include cellulose acetate tow, gathered cellulose acetate web, polypropylene tow, gathered polypropylene web, gathered polyester web, gathered paper, and strands of reconstituted tobacco. In preferred embodiments, each section of filter material, 36 and 38, comprises a fibrous filter material, such as cellulose acetate tow.

The sections of filter material, 36 and 38, may further include a plasticizing component, such as triacetin or carbowax. In one embodiment, the plasticizer component of the filter material comprises triacetin and carbowax in a 1:1 ratio by weight. The total amount of plasticizer is generally about 4 to about 20 percent by weight, preferably about 6 to about 12 percent by weight.

Each section or segment of filter material, 36 and 38, can vary in length. Typically, each section of filter material is about 5 to about 25 mm in length, frequently about 5 to about 15 mm in length.

The particulate removal efficiency of each segment of filter material in the filter element can vary. For fibrous filter materials, particulate removal efficiency is preferably quantified in terms of weight per unit length of the filaments forming the fibers. Exemplary filter materials exhibit a filtration efficiency of about 1.8 to about 10 denier per filament. Each filter segment in a multi-segment filter element can have the same or different filtration efficiency. In one embodiment, the section of filter material 38 proximal to the tobacco rod 12 has a higher particulate removal efficiency than the section of filter material 36 distal from the tobacco rod. For example, the filaments of the tobacco end section of filter material 38 can have a lower weight per unit length than the filaments of the mouth end section of filter material 36. Exemplary filaments for use in the tobacco end section of filter material 38 have a weight per unit length of less than about 2.5 denier per filament, preferably about 1.8 to about 2.5. Exemplary filaments for use in the mouth end section of filter material 36 have a weight per unit length of greater than about 3.0 denier per filament, preferably about 3.0 to about 10.0. Alternatively, the mouth end section of filter material 36 can have higher particulate removal efficiency than the tobacco end section of filter material 38.

In each of the embodiments described above, the compartment 32 formed between the two sections of filter material, 36 and 38, has a length of about 5 to about 50 mm, typically about 5 to about 30 mm. In those embodiments wherein the compartment 32 is divided into two compartments, the semi-permeable dividing barrier 42 may be any material that is permeable to mainstream smoke, but impermeable to the adsorbent 34 and thus able to retain the adsorbent in a defined portion of the compartment. Exemplary semi-permeable barriers 42 include highly porous paper (e.g., about 100 CORESTA and above) and any of the materials suitable as the sections of filter material, 36 and 38.

The length of the barrier 42 will vary. Typically, the barrier 42 will have a length of about 0.5 to about 10 mm, more preferably about 0.5 to about 5 mm. Each compartment of the divided compartment 32 will typically have a length of about 5 to about 20 mm, frequently about 5 to about 10 mm.

If desired, suitable catalytic compounds, e.g., for the conversion of carbon monoxide to carbon dioxide, can be incorporated into one or more segments of the filter element 20. Exemplary catalysts include noble metals (e.g., silver, gold, platinum), metal oxides, ceramics, and mixtures thereof.

Experimental

The following examples are provided to illustrate embodiments of the present invention, and should not be considered to limit the scope of the invention or the claims appended hereto. Unless otherwise noted, all parts and percentages are by weight. The cigarettes so described in the examples can be handmade or manufactured by machine using, for example, a Pilot Cigarette Maker from Hauni-Werk Korber & Co. KG.

EXAMPLE 1

A cigarette is prepared using a representative American blend comprising about 13 percent burley tobacco, about 20 percent flue-cured tobacco, about 17 percent reconstituted tobacco material, and about 17 percent Oriental tobacco. About 3 percent of an aqueous casing material, comprising humectants and flavors, is applied to the tobacco blend prior to cutting into filler form. About 30 percent expanded, composed of primarily flue-cured tobacco, is then added to the cut tobacco blend to prepare the final cut filler. The blend is equilibrated to final moisture content of about 13 percent prior to cigarette manufacture.

The tobacco blend is used to prepare a cigarette having a length of about 84 mm. The tobacco rod length is about 57 mm and the filter element length is about 27 mm. The tobacco rod includes a charge of tobacco cut filler weighing about 0.600 g contained in a circumscribing cigarette paper wrap of the type that is available as No. 456 from Tervakoski. The tipping material circumscribes the length of the filter element and extends about 4 mm down the length of the tobacco rod.

The filter element of the cigarette has the general configuration as shown in FIG. 2. Filter elements of this general type are available from Baumgartner Inc., Switzerland. The cigarette has a filter element comprising a 12 mm mouth-end cellulose acetate tow (2.5 denier per filament/35,000 total denier) segment with 7% triacetin, a 7 mm compartment filled with granular carbon available as G277 (85 carbon tetrachloride activity and size 20×50 mesh) from PICA, and an 8 mm cellulose acetate tow (8.0/32,000) tobacco-end segment with 7% triacetin.

A ring of laser perforations is provided around the periphery of each cigarette about 13 mm from the extreme mouth-end thereof. The perforations penetrate through the tipping paper and plug wrap, and can be provided using a Laboratory Laser Perforator from Hauni-Werk Korber & Co. KG. The cigarettes are air diluted to about 34 percent. The cigarettes yield about 10 mg "tar" and 0.8 mg nicotine when smoked under FTC smoking conditions.

EXAMPLE 2

Cigarettes are provided as described in Example 1, except the filter element comprises an 8 mm mouth-end end cellulose acetate tow (8.0/32,000) segment with 7% triacetin, a 7 mm compartment filled with granular carbon available as G277 (85 carbon tetrachloride activity and size 20×50 mesh) from PICA, and a 12 mm cellulose acetate tow (2.5/35,000) tobacco-end segment with 7% triacetin. The cigarettes yield about 10 mg "tar" and 0.8 mg nicotine when smoked under FTC smoking conditions.

The cigarette of Example 2 made with the filter segment having the higher particulate removal efficiency proximal to the tobacco rod and with the ventilation holes positioned closer to the tobacco rod provides greater reduction in certain volatile and semi-volatile mainstream smoke components as compared to the cigarette of Example 1 when smoked under FTC smoking conditions. The cigarettes of Example 2 provide about 5 percent reduction of catechol, about 28 percent reduction in p-,+m-cresol, about 17 percent reduction in formaldehyde, about 29 percent reduction in acetaldehyde, about 65 percent reduction in acetone, about 67 percent reduction in acrolein, and about 28 percent reduction in hydrogen cyanide.

EXAMPLE 3

Cigarettes are provided as described in Example 1. However, a flavor capsule is inserted by hand into the mouth-end plasticized cellulose acetate tow such that the capsule is imbedded in the mouth-end section of filter material. This flavor capsule is obtainable from Mane Aromatic Flavors as Reference E127384 (menthol). The cigarettes can be smoked with or without breaking the capsule.

EXAMPLE 4

Exemplary cigarettes are prepared using a tobacco rod, paper wrap and tipping material as described in Example 1. The tobacco rod length of the exemplary cigarettes is about 57 mm and the filter element length is about 30 mm.

The exemplary cigarettes have the general configuration shown in FIG. 3. The exemplary cigarettes have a filter element comprising a 10 mm mouth end cellulose acetate plug of 2.5/35,00 tow with 7% triacetin, a 7 mm compartment filled with granular activated carbon available as G277 from PICA (85 carbon tetrachloride activity; particle size 20×50 mesh), a 2 mm cellulose acetate plug of 2.5/35,000 tow, a 5 mm hollow compartment, and a 6 mm cellulose acetate plug of 8.0/32,000 tow with 7% triacetin proximal to the tobacco rod. The cigarettes are air diluted to about 34 percent. The cigarettes yield about 10 mg "tar" and 0.8 mg nicotine when smoked under FTC smoking conditions.

The exemplary cigarettes having the divided compartment containing the adsorbent in the downstream compartment and having a hollow upstream compartment provides greater reduction of certain vapor phase mainstream smoke components as compared to the cigarette of Example 1 when smoked under FTC smoking conditions. The exemplary cigarettes provide about 6% reduction of formaldehyde, about 7% reduction in acetaldehyde, about 11% reduction in acetone, and about 8% reduction in acrolein.

EXAMPLE 5

Exemplary cigarettes are prepared using a tobacco rod, paper wrap and tipping material as described in Example 1. The tobacco rod length of the exemplary cigarettes is about 57 mm and the filter element length is about 27 mm.

The exemplary cigarettes have a filter element comprising an 8 mm mouth-end end cellulose acetate tow (8.0/32,000) segment with 7% triacetin, a 7 mm compartment filled with granular carbon available as G277 (85 carbon tetrachloride activity and size 20×50 mesh) from PICA, and a 12 mm cellulose acetate tow (2.5/35,000) tobacco-end segment with 7% triacetin. The tobacco end segment of filter material in some exemplary cigarettes comprises 6 tubes 0.2 to 3 mm in diameter inserted around the periphery. The tobacco end segment of filter material in other exemplary cigarettes comprises a single tube 0.2 to 3 mm in diameter inserted in the center of the filter segment. The cigarettes are air diluted to about 34 percent. The cigarettes yield about 10 mg "tar" and 0.8 mg nicotine when smoked under FTC smoking conditions.

The exemplary cigarettes having one or more tubes in the tobacco end segment of filter material provide greater reduction of certain vapor phase mainstream smoke components as compared to the cigarette of Example 1. The exemplary cigarettes provide about 13-18% reduction of formaldehyde, about 3-4% reduction in acetaldehyde, about 7-12% reduction in acetone, and about 15-16% reduction in acrolein.

EXAMPLE 6

Exemplary cigarettes are prepared using a tobacco rod, paper wrap and tipping material as described in Example 1. The tobacco rod length of the exemplary cigarettes is about 57 mm and the filter element length is about 27 or 31 mm.

The first exemplary cigarette has a filter element comprising a 10 mm mouth-end cellulose acetate tow (2.5 denier per filament/35,000 total denier) segment with 7% triacetin, a 7 mm compartment filled with granular carbon available as G277 (85 carbon tetrachloride activity and size 20×50 mesh) from PICA, a 2 mm low efficiency cellulose acetate tow (8.0/32,000) with 7% triacetin, a 4 mm compartment filled with polymeric ion-exchange resin (benzenemethanamine, ar-ethyenyl-N,N-dimethyl-, polymer with divinylbenzene known as DCA11, particle size 16×50 mesh, from Mitsubishi Chemical Corp.), and an 8 mm cellulose acetate tow (8.0/32,000) tobacco-end segment with 7% triacetin. The second exemplary cigarette has a filter element comprising a 12 mm mouth-end cellulose acetate tow (2.5 denier per filament/35,000 total denier) segment with 7% triacetin, a 7 mm compartment filled with granular carbon available as G277 (85 carbon tetrachloride activity and size 20×50 mesh) from PICA., and an 8 mm cellulose acetate tow (8.0/32,000) tobacco-end with 7% triacetin and DCA11 ion-exchange resin embedded within the cellulose acetate fibers. The cigarettes are air diluted to about 34 percent. The cigarettes yield about 10 mg "tar" and 0.8 mg nicotine when smoked under FTC smoking conditions.

The exemplary cigarettes containing activated carbon and an ion-exchange resin provide greater reduction of formaldehyde as compared to the cigarette of Example 1 when smoked under FTC smoking conditions. The experimental cigarettes provide about 18-32% reduction of formaldehyde.

EXAMPLE 7

Exemplary cigarettes are prepared using a tobacco rod, paper wrap and tipping material as described in Example 1. The tobacco rod length of the exemplary cigarettes is about 57 mm and the filter element length is about 27 mm.

The exemplary cigarettes have a filter element comprising a 12 mm mouth-end cellulose acetate tow (2.5 denier per filament/35,000 total denier) segment with 7% triacetin, a 7 mm compartment filled with granular almond-shell carbon (70 carbon tetrachloride activity and size 20×50) mesh from PICA, and an 8 mm cellulose acetate tow (8.0/32,000) tobacco-end segment with 7% triacetin. The cigarettes are air diluted to about 34 percent. The cigarettes yield about 10 mg "tar" and 0.8 mg nicotine when smoked under FTC smoking conditions.

The exemplary cigarettes containing almond shell carbon provides greater reduction of carbonyl compounds as compared to the cigarette of Example 1 containing coconut-shell carbon (G277) when smoked under FTC and alternative smoking conditions. The exemplary cigarettes provide about 20-40% reduction of carbonyls.

Many modifications and other embodiments of the invention will come to mind to one skilled in the art to which this invention pertains having the benefit of the teachings presented in the foregoing description; and it will be apparent to those skilled in the art that variations and modifications of the present invention can be made without departing from the scope or spirit of the invention. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A cigarette comprising a tobacco rod and a filter element connected to the tobacco rod, said filter element having an end proximal to the tobacco rod and an end distal from the tobacco rod, wherein said filter element comprises:

a first longitudinally extending section of filter material proximal to the tobacco rod;

a second longitudinally extending section of filter material distal from the tobacco rod and spaced apart from said first section of filter material, the two sections of filter material defining a compartment therebetween; and an adsorbent material contained within at least a portion of said compartment, wherein a plurality of channels extend through said first section of filter material, said channels being defined by walls that extend in a direction parallel to the outer surface of the filter element and adapted for passage of mainstream smoke between said tobacco rod and said compartment, and wherein said first section of filter material has a greater particulate removal efficiency than said second section of filter material.

2. The cigarette of claim 1, wherein the plurality of channels are spaced along the periphery of first section of said filter material.

3. The cigarette of claim 1, wherein the plurality of channels are proximal to the central axis of said first section of filter material.

4. The cigarette of claim 1, wherein said channels have a total cross-sectional area of about 0.1 to about 50 $mm^2$.

5. The cigarette of claim 4, wherein said channels have a total cross-sectional area of about 0.5 to about 15 $mm^2$.

6. The cigarette of claim 1, wherein said first section of filter material and said second section of filter material are each independently selected from the group consisting of cellulose acetate tow, gathered cellulose acetate web, polypropylene tow, gathered polypropylene web, gathered polyester web, gathered paper, and strands of reconstituted tobacco.

7. The cigarette of claim 1, wherein said first section of filter material and said second section of filter material comprise plasticized cellulose acetate tow.

8. The cigarette of claim 1, wherein the overall length of the filter element is about 15 to about 65 mm

9. The cigarette of claim 8, wherein the overall length of the filter element is about 25 to about 50 mm.

10. The cigarette of claim 1, wherein the length of each of the first and second sections of filter material is about 5 to about 25 mm.

11. The cigarette of claim 10, wherein the length of each of the first and second sections of filter material is about 5 to about 15 mm.

12. The cigarette of claim 1, wherein said compartment has a length of about 5 to about 20 mm.

13. The cigarette of claim 12, wherein said compartment has a length of about 5 to about 10 mm.

14. The cigarette of claim 1, wherein said adsorbent is selected from the group consisting of activated carbon, molecular sieves, clays, activated aluminas, silica gels, and mixtures thereof.

15. The cigarette of claim 1, wherein said adsorbent is activated carbon.

16. The cigarette of claim 15, wherein the activated carbon has an activity of about 60 to about 150 Carbon Tetrachloride Activity.

17. The cigarette of claim 1, wherein said adsorbent is in granular form.

18. The cigarette of claim 17, wherein said adsorbent has a particle size of about 8×16 mesh to about 30×70 mesh.

19. The cigarette of claim 1, wherein the cross-sectional shape of the channels is rectangular or circular.

20. The cigarette of claim 1, wherein the number of channels is 2 to about 20.

21. The cigarette of claim 1, wherein the diameter of each channel is about 0.5 to about 8 mm.

22. The cigarette of claim 21, wherein the diameter of each channel is about 1 to about 3 mm.

23. The cigarette of claim 1, wherein said first section of filter material and said second section of filter material comprise a fibrous filter material, and said first section of filter material comprises filaments having a lower weight per unit length than the filaments of said second section of filter material.

24. The cigarette of claim 23, wherein said first section of filter material comprises filaments having a weight per unit length of less than about 2.5 denier per filament and said second section of filter material comprises filaments having a weight per unit length of greater than about 3.0 denier per filament.

25. The cigarette of claim 24, wherein said first section of filter material comprises filaments having a weight per unit length of about 1.8 to about 2.5 denier per filament and said second section of filter material comprises filaments having a weight per unit length of about 3.0 to about 10 denier per filament.

26. A cigarette comprising a tobacco rod and a filter element connected to the tobacco rod, said filter element having an end proximal to the tobacco rod and an end distal from the tobacco rod, wherein said filter element comprises:

a first longitudinally extending section of filter material proximal to the tobacco rod;

a second longitudinally extending section of filter material distal from the tobacco rod and spaced apart from said first section of filter material, the two sections of filter material defining a compartment therebetween; and an adsorbent material contained within at least a portion of said compartment, wherein the first section of filter material further comprises a plurality of tubes inserted into and extending through said first section of filter material, each tube defining a channel adapted for passage of mainstream smoke between said tobacco rod and said compartment, and wherein said first section of filter material has a greater particulate removal efficiency than said second section of filter material.

27. The cigarette of claim 26, wherein the cross-sectional shape of the tubes is rectangular or circular.

28. The cigarette of claim 26, wherein the number of tubes is 2 to about 20.

29. The cigarette of claim 26, wherein the diameter of each tube is about 0.5 to about 8 mm

30. The cigarette of claim 26, wherein the plurality of tubes are spaced along the periphery of first section of said filter material.

31. The cigarette of claim 26, wherein the plurality of tubes are proximal to the central axis of said first section of filter material.

32. The cigarette of claim 26, wherein said tubes have a total cross-sectional area of about 0.1 to about 50 $mm^2$.

33. The cigarette of claim 26, wherein said adsorbent is selected from the group consisting of activated carbon, molecular sieves, clays, activated aluminas, silica gels, and mixtures thereof.

34. The cigarette of claim 26, wherein said first section of filter material and said second section of filter material comprise plasticized cellulose acetate tow.

35. A cigarette comprising a tobacco rod and a filter element connected to the tobacco rod, said filter element having an end proximal to the tobacco rod and an end distal from the tobacco rod, wherein said filter element comprises:

a first longitudinally extending section of filter material positioned proximal to the tobacco rod;

a second longitudinally extending section of filter material positioned distal from the tobacco rod and spaced apart from said first section of filter material, the two sections of filter material defining a compartment therebetween; and an adsorbent material contained within at least a portion of said compartment, wherein a plurality of channels extend through said first section of filter material, said channels having a rectangular or circular cross-sectional shape and being adapted for passage of mainstream smoke between said tobacco rod and said compartment, and wherein said first section of filter material has a greater particulate removal efficiency than said second section of filter material.

36. The cigarette of claim 35, wherein the number of channels is 2 to about 20.

37. The cigarette of claim 35, wherein the plurality of channels are spaced along the periphery of first section of said filter material.

38. The cigarette of claim 35, wherein the plurality of channels are proximal to the central axis of said first section of filter material.

39. The cigarette of claim 35, wherein said channels have a total cross-sectional area of about 0.1 to about 50 $mm^2$.

40. The cigarette of claim 35, wherein said adsorbent is selected from the group consisting of activated carbon, molecular sieves, clays, activated aluminas, silica gels, and mixtures thereof.

41. The cigarette of claim 35, wherein said first section of filter material and said second section of filter material comprise plasticized cellulose acetate tow.

42. The cigarette of claim 26, wherein the tubes have a self-supporting polymeric structure.

* * * * *